United States Patent [19]

Berger et al.

[11] 4,424,917

[45] Jan. 10, 1984

[54] SELF-CLEANING VALVE

[75] Inventors: Richard F. Berger, Huntington; Greg Pardes, New York; Bernard R. Gerber, Jamaica, all of N.Y.

[73] Assignee: The Reseal Container Corporation of America, New York, N.Y.

[21] Appl. No.: 269,255

[22] Filed: Jun. 1, 1981

[51] Int. Cl.[3] ..... B65D 35/28

[52] U.S. Cl. ..... 222/103; 222/148

[58] Field of Search ..... 222/103, 212, 148, 506, 222/517, 528, 529, 96, 494, 491, 214; 251/10

[56] References Cited

U.S. PATENT DOCUMENTS 4,349,133 9/1982 Christine ..... 222/214 X

*Primary Examiner*—Stanley H. Tollberg

*Attorney, Agent, or Firm*—Toren, McGeady and Stanger

[57] ABSTRACT

A self-cleaning valve used at the outlet of a container has an elongated flexible flattenable tube with an inlet end for receiving material to be dispensed from the container and an outlet end for dispensing the material. In the at-rest condition of the valve, a section of the tube extending from the outlet end is supported between a housing surface and a closure-cleaning lever member spring-mounted on the housing so that it pivots about a fulcrum. By pressing down on one end of the lever member, the tube can be opened so that material, forced out of the container, can be dispensed from the outlet end of the tube. After the material has been dispensed, the lever member is pivoted along the outside surface of the tube pressing the tube against the housing surface so that any material remaining within the tube is forced out of the outlet end.

8 Claims, 4 Drawing Figures

SELF-CLEANING VALVE

SUMMARY OF THE INVENTION

The present invention is directed to a self-cleaning valve for use on containers from which material is to be dispensed.

In the past valves have been used for containers for retaining pressurized material within the container until the valve is opened. The material dispensed can be a liquid, a flowable solids, a solution, or a paste which will flow is a pressurized force is applied to the material and the valve on the container is open.

When the container and valve are in the at-rest condition, the valve must provide a positive closure preventing any flow of air from entering the container. Air leaking into the container may have a deleterious effect on the material. If in the dispensing operation material builds up in the passageway out of the valve, such material may prevent a proper closure of the valve allowing air to enter the container or permitting the contents of the container to flow out.

Therefore, it is the primary object of the present invention to provide a self-cleaning valve which clears the passageway out of the valve of any material dispensed so that the valve closes properly.

Another object of the present invention is to provide a positive closure for the valve which must be manually actuated to place the valve in the opened or dispensing condition.

Still another object of the present invention is to provide a simple valve construction which can be easily and inexpensively manufactured and can be operated in a simple manner so that after dispensing material the valve affords a self-cleaning action.

In accordance with the present invention, a valve including an axially elongated flexible flattenable tube is mounted on a container from which material is to be dispensed. Various types of containers may be used, for instance, a container with a compressible gas or a collapsible container which discharges the material as a collapsing force is applied to the container. The tube has an inlet end arranged to be connected to the container and an opposite outlet end from which the material is dispensed after flow through the passageway formed by the tube. In the at-rest condition of the valve, the tube is in a flattened position from the outlet end to a location intermediate the outlet end and the inlet end. The flattened section of the tube is supported on a surface of a valve housing and a closure-cleaning lever member rests against the opposite side of the flattened section. The combination of the lever member and the housing surface maintains the tube in the flattened closed condition.

The housing has a projection acting as a fulcrum for the lever member. At its opposite ends, springs act on the lever member for maintaining it in the closed position and for effecting a rolling action of the lever member against the flattened section of the tube to provide the cleaning or clearing effect when the dispensing operation is completed.

If material is to be dispensed, one end of the lever member is pressed against the biasing action of one spring so that the lever member pivots about the projection on the housing into a position releasing the flattening force on the tube so that the tube can be opened by the pressure acting on the material in the container with the material flowing out of the outlet end of the tube.

When the dispensing step is completed, the springs acting on the lever member cause it to bear downwardly against the tube returning it to the flattened condition and pushing any material remaining within the tube forwardly toward the outlet end so that the passageway through the tube is cleared of any material which might block or interfere with the required closure.

After the passageway through the tube is cleared the springs balance the lever member so that it is held in the at-rest condition flattening the tube and providing a seal closure for the passageway.

By pressing a finger down against one end of the lever member, the valve can be opened, subsequently the springs acting on the valve provide the self-cleaning feature.

Preferably, the tube is formed of natural rubber or an elastomer including synthetic rubbers or plastics materials. The material forming the tube must have sufficient resilience so that it will open and close effectively during multiple uses of the valve.

While the valve can be used with a container holding a pressurized gas for dispensing material, it can also be placed on the outlet end of a collapsible container such as disclosed in the Rauh et al Pat. No. 3,506,163. When using such a container, the collapsing action used to discharge the material assures that the container and the valve are filled with material in the at-rest condition. In other words, since the container collapses so that it is always filled with material, the material fills that portion of the valve upstream from the location at which the lever member provides a seal closure when the valve is in the at-rest condition.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
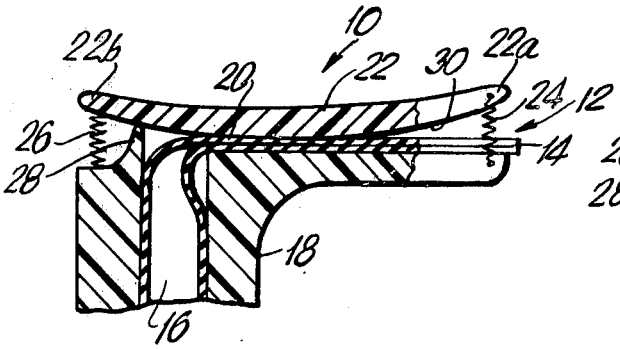
FIG. 1 is a cross-sectional view of a self-cleaning valve with the valve shown in the at-rest position.

In the drawing a self-cleaning valve 10 is illustrated made up of an axially elongated flexible flattenable tube 12 having an outlet end 14 and an inlet end 16 with the inlet end located within a housing 18 and with a section 20 of the tube 12 disposed approximately perpendicularly to the inlet end supported on the housing 18 and extending to the outlet end 14. A closure-cleaning lever member 22 extending in the axial direction of section 20 is supported on the upper surface of the section 20 and it has one end connected to the housing 18 adjacent the outlet end 14 by a first spring 24 and its other end is connected by a second spring 26 to the housing.

Housing 18 has an upward projection 28 located close to the second spring 26 and forming a fulcrum for the closure-cleaning lever member 22. The lever member 22 has a first end 22*a* adjacent the outlet end of the tube and a second end 22*b* located above the opposite side of the housing.

The lever member 22 has an arcuate convex surface 30 in contact with the outside surface of section 30 of the tube 12. The contact of surface 30 with section 20 can be moved along the outside surface of the section from adjacent the part of the housing containing the inlet end 16 of the tube 12 to adjacent the outlet end 14.

The valve 10 is intended to be mounted on a container, not shown, for discharging a material from the container which is capable of flowing through the passageway in the tube 12. The valve can be used to dispense a flowable solids material, a liquid, a paste, a suspension or the like.

The flexible tube 12 can be formed of natural rubber or an elastomeric material having a similar resilient characteristic. The elastomeric material may be synthetic rubber or a plastics material.

The housing 18 and the closure-cleaning lever member 22 can be formed of a hard plastics material.

In FIG. 1 the arcuate surface 30 of the lever member 22 bears against the tube 12 providing a positive closure against flow of material from the inlet 16 to the outlet end 14 of the valve. Normally the valve is attached to a container in which the material is pressurized so that it can be dispensed through the valve from its outlet end 14. The pressure can be provided by a gas within the container, or by the use of a collapsible container which pressurizes the material when it is compressed or by other conventional pressurizing means for containers.

In the at-rest position shown in FIG. 1, the lever member 22 is held at its opposite ends by the springs 24 and 26 so that it remains in position and provides a seal closure for the tube 12 by flattening the passageway through the tube. When the material is to be dispensed through the valve 12, the end 22*b* of the lever member 22 is pressed downwardly against compression spring 26 so that the lever member pivots counter-clockwise as viewed in FIG. 1 about the fulcrum 28 on the housing 18 with its arcuate surface 30 rolling along the top surface of the tube 12 until it reaches a point where material can flow through the passageway within the tube with the pressure of the material opening the passageway from the flattened condition shown in FIG. 1. By maintaining a downward force on the end 22*b* of the lever member, the valve remains in the open or dispensing condition against the upwardly biasing action of the compression spring 26.

Figure 2:
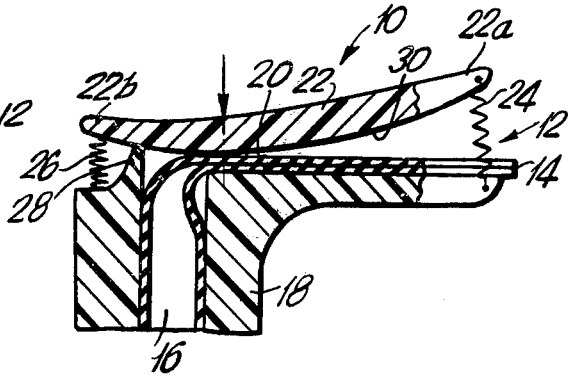
FIG. 2 is a view similar to FIG. 1 showing the self-cleaning valve being opened.
Figure 3:
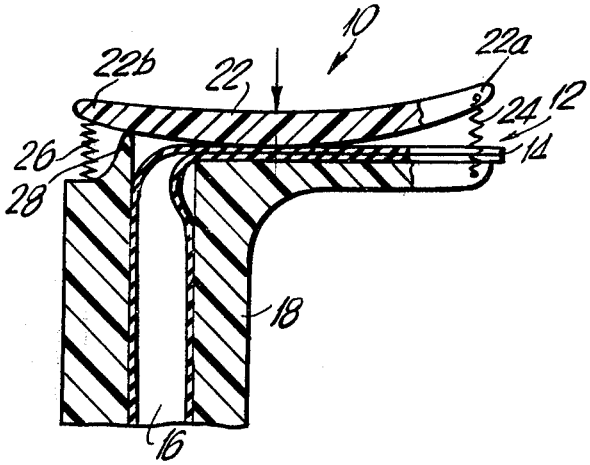
FIG. 3 is a cross-sectional view similar to FIG. 1 with the self-cleaning valve in the cleaning condition.
Figure 4:
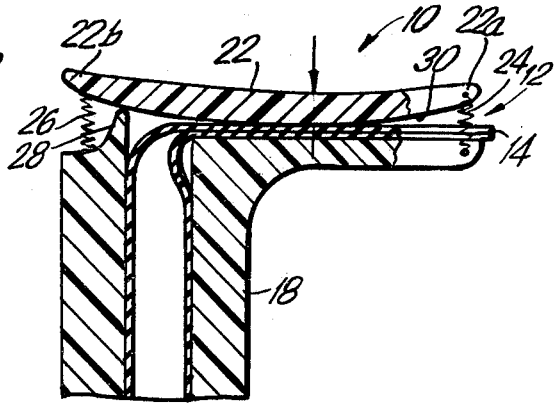
FIG. 4 is another cross-sectional view similar to FIG. 3 in still another position of the cleaning condition of the valve.

When the desired amount of material has been dispensed, the downward pressure on the end 22*b* of the lever member 22 is released and the spring 26 pushes the lever member 22 clockwise in the upward direction with the arcuate surface 30 rolling on the outside surface of the tube 12 and pressing any material within the tube passageway toward the outlet end 14 providing a cleaning effect. In FIG. 2 the end 22*b* is shown pressed downwardly against the spring 26 with the arcuate surface 30 moving to a position where the valve opens. In FIG. 3 the downward pressure on the end 22*b* of the lever member 22 has been released and the combination of the compression spring 26 and the tension spring 24 pivots the lever member clockwise with the point of contact between the arcuate surface 30 and the outside surface of the tube 12 moving toward the outlet end 14. The springs 26 and 24 are properly sized so that the closure-cleaning lever member 22 is rocked or pivoted about the fulcrum 28 in the cleaning operation with the arcuate surface 30 rolling on the outside surface of the tube 12 to the outlet end 14 of the tube for clearing out of the tube any material left in the passageway at the end of the dispensing operation. When the cleaning step is completed the springs 24, 26 balance the lever member 22 in the at-rest position maintaining the tube flattened and assuring a positive closure of the tube passageway. The spring force must be sufficient to hold the valve closed against any force acting on the material in the container to which the valve is connected.

By using the valve 10 it is assured that the tube 12 remains in the closed condition when no material is to be dispensed and after material has been dispensed the tube is cleared of any material so that there is no interference with the closure and it is assured that no air enters through the valve back into the container. In the disclosed embodiment one form of the closure-cleaning lever member has been illustrated, however, it can be appreciated that the configuration of the surface of the lever member and of the housing and the position of the fulcrum can be varied to achieve the same result.

While a specific embodiment of the invention has been shown and described in detail to illustrate the application of the inventive principles, it will be understood that the invention may be embodied otherwise without departing from such principles.

We claim:

1. Self-cleaning valve for use at the outlet of a container for dispensing a material from the valve and comprising an axially elongated flexible flattenable tube having an inlet end through which the material enters the valve and an outlet end from which the material is dispensed after passing through said tube, said tube having an at-rest condition and a dispensing condition, said tube forming a passageway extending between said inlet end and said outlet end, said tube having an axially extending first section extending from said outlet end toward said inlet end and an axially extending second section extending from the end of said first section spaced from said outlet end to said inlet end, said first section having a first side and an opposite second side, a housing forming a support surface for said first side of said first section of said tube, said support surface extending in the axial direction of said first section and having a first end adjacent said outlet end and a second end spaced in the axial direction of said first section from said outlet end, said housing having a projection extending therefrom outwardly beyond said support surface and the surface of said projection extending outwardly beyond said support surface forming a fulcrum, a closure-cleaning lever member extending in the axial direction of said first section and located on the opposite side of said first section from said support surface and disposed in contact with said second side of said first section, said lever member having a first end located adjacent said outlet end of said tube and a second end extending beyond the second end of said support surface, said lever member is pivotally supported on said fulcrum intermediate the first and ends thereof so that it can be pivoted and maintained in moving contact with said second side of said first section of said tube between the first and second ends of said first section so that in the at-rest condition said first section is in the flattened state cleared of the material to be dispensed and in the dispensing condition said first section is opened from the flattened state so that the material to be dispensed can pass through said first section.

2. Self-cleaning valve, as set forth in claim 1, wherein a first spring member connects the first end of said lever member to said housing and a second spring member extends between said second end of said lever member and said housing.

3. Self-cleaning valve, as set forth in claim 2, wherein said first spring member is a tension spring and said second spring member is a compression spring.

4. Self-cleaning valve, as set forth in claim 3, wherein said compression spring is supported on said housing on the opposite side of said projection from said outlet end of said valve and presses upwardly against the surface of said lever member in contact with the outside surface of said tube.

5. Self-cleaning valve, as set forth in claim 1, wherein said support surface of said housing is planar and said lever member having a rolling surface facing said support surface and contacting said tube and said rolling surface is arcuate and convex.

6. Self-cleaning valve, as set forth in claim 3, wherein said compression spring and said tension spring hold said lever member in the at-rest condition with said lever member contacting said first section of said tube adjacent the end thereof spaced from said outlet end of said tube.

7. Self-cleaning valve, as set forth in claim 5, wherein said projection from said housing extends outwardly beyond the planar support surface on said housing.

8. Self-cleaning valve, as set forth in claim 1, wherein said tube is L-shaped having a first leg including said first section and said outlet end and a second leg including said inlet end.

* * * * *